US007798465B1

(12) United States Patent
Meverden

(10) Patent No.: US 7,798,465 B1
(45) Date of Patent: Sep. 21, 2010

(54) REVERSIBLE HEAT PUMP STAND

(76) Inventor: Brayden Meverden, 109 Riverwood Dr. West, St. Paul Park, MN (US) 55071

( * ) Notice: Subject to any disclaimer, the term of this patent is extended or adjusted under 35 U.S.C. 154(b) by 424 days.

(21) Appl. No.: 11/688,992

(22) Filed: Mar. 21, 2007

(51) Int. Cl.
*F16M 9/00* (2006.01)

(52) U.S. Cl. ..... 248/678; 248/645; 248/679; 248/346.01; 248/346.02; 248/346.3; 248/153; 248/175

(58) Field of Classification Search ..... 248/153, 248/175, 678, 346.01, 346.02, 156, 346.3, 248/679
See application file for complete search history.

(56) References Cited

U.S. PATENT DOCUMENTS 578,012 A * 3/1897 Harris ..... 4/285
1,612,937 A * 1/1927 Mitchell ..... 108/59
1,947,932 A * 2/1934 Fante ..... 211/85.4
2,940,599 A * 6/1960 Gentner ..... 211/41.1
3,013,670 A * 12/1961 Mayer ..... 108/181
3,722,845 A * 3/1973 Unger ..... 248/346.03
4,000,827 A * 1/1977 Emery ..... 220/4.28
4,118,083 A * 10/1978 Lackey et al. ..... 312/100
5,076,534 A * 12/1991 Adam ..... 248/678
5,278,742 A * 1/1994 Garrett ..... 362/233
5,611,974 A * 3/1997 Welch et al. ..... 264/34
5,664,394 A * 9/1997 Sweeney ..... 52/782.1
5,950,980 A * 9/1999 Folmar ..... 248/678
5,961,093 A * 10/1999 Jones et al. ..... 248/678
6,126,131 A * 10/2000 Tietz ..... 248/346.01
6,518,499 B1 * 2/2003 Kessler ..... 174/50
6,520,354 B1 * 2/2003 Skvorecz ..... 211/181.1
7,086,339 B2 * 8/2006 Apps et al. ..... 108/57.25
7,266,956 B2 * 9/2007 Norrell et al. ..... 62/125
7,334,421 B1 * 2/2008 Cantolino ..... 62/259.1
2003/0183741 A1 * 10/2003 Milner ..... 248/679
2003/0193006 A1 * 10/2003 Harris ..... 248/678

* cited by examiner

*Primary Examiner*—J. Allen Shriver, II
*Assistant Examiner*—Alaeddin Mohseni
(74) *Attorney, Agent, or Firm*—David A. Lingbeck

(57) ABSTRACT

A reversible heat pump stand for securely supporting heat pumps and allowing drainage of water without ice buildup. The reversible heat pump stand includes a first support frame for securely supporting a heat pump; and also includes a second support frame being interconnected to the first support frame for also securely supporting the heat pump; and further includes support members interconnecting the first and second support frames.

2 Claims, 3 Drawing Sheets

REVERSIBLE HEAT PUMP STAND

BACKGROUND OF THE INVENTION

1. Field of the Invention

The present invention relates to mechanical unit stand and more particularly pertains to a new reversible heat pump stand for securely supporting heat pumps and allowing drainage of water without ice buildup.

2. Description of the Prior Art

The use of mechanical unit stands is known in the prior art. More specifically, mechanical unit stands heretofore devised and utilized are known to consist basically of familiar, expected and obvious structural configurations, notwithstanding the myriad of designs encompassed by the crowded prior art which have been developed for the fulfillment of countless objectives and requirements. The prior art includes a platform having a grated bottom wall and side walls and being mounted upon adjustable legs. Another prior art includes a cement compound base having posts being threaded into the base and extending upwardly therefrom. Other prior art also includes solid structures which are confronted with ice buildup from the drainage from the heat pump since the water has no outlet.

While these devices fulfill their respective, particular objectives and requirements, the aforementioned patents do not disclose a new reversible heat pump stand.

SUMMARY OF THE INVENTION

The general purpose of the present invention, which will be described subsequently in greater detail, is to provide a new reversible heat pump stand which has many of the advantages of the mechanical unit stands mentioned heretofore and many novel features that result in a new reversible heat pump stand which is not anticipated, rendered obvious, suggested, or even implied by any of the prior art mechanical unit stands, either alone or in any combination thereof. The present invention includes a first support frame for securely supporting a heat pump; and also includes a second support frame being interconnected to the first support frame for also securely supporting the heat pump; and further includes support members interconnecting the first and second support frames. None of the prior art includes the combination of the elements of the present invention.

There has thus been outlined, rather broadly, the more important features of the reversible heat pump stand in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new reversible heat pump stand which has many of the advantages of the mechanical unit stands mentioned heretofore and many novel features that result in a new reversible heat pump stand which is not anticipated, rendered obvious, suggested, or even implied by any of the prior art mechanical unit stands, either alone or in any combination thereof.

Still another object of the present invention is to provide a new reversible heat pump stand for securely supporting heat pumps and allowing drainage of water without ice buildup.

Still yet another object of the present invention is to provide a new reversible heat pump stand that is lightweight and is stackable for easy shipment.

Even still another object of the present invention is to provide a new reversible heat pump stand that can be reversed to support and prevent heat pumps from sliding off the stand.

Also another object of the present invention is to provide a new reversible heat pump stand that appearance blends in with the appearance of the heat pump.

These together with other objects of the invention, along with the various features of novelty which characterize the invention, are pointed out with particularity in the claims annexed to an forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
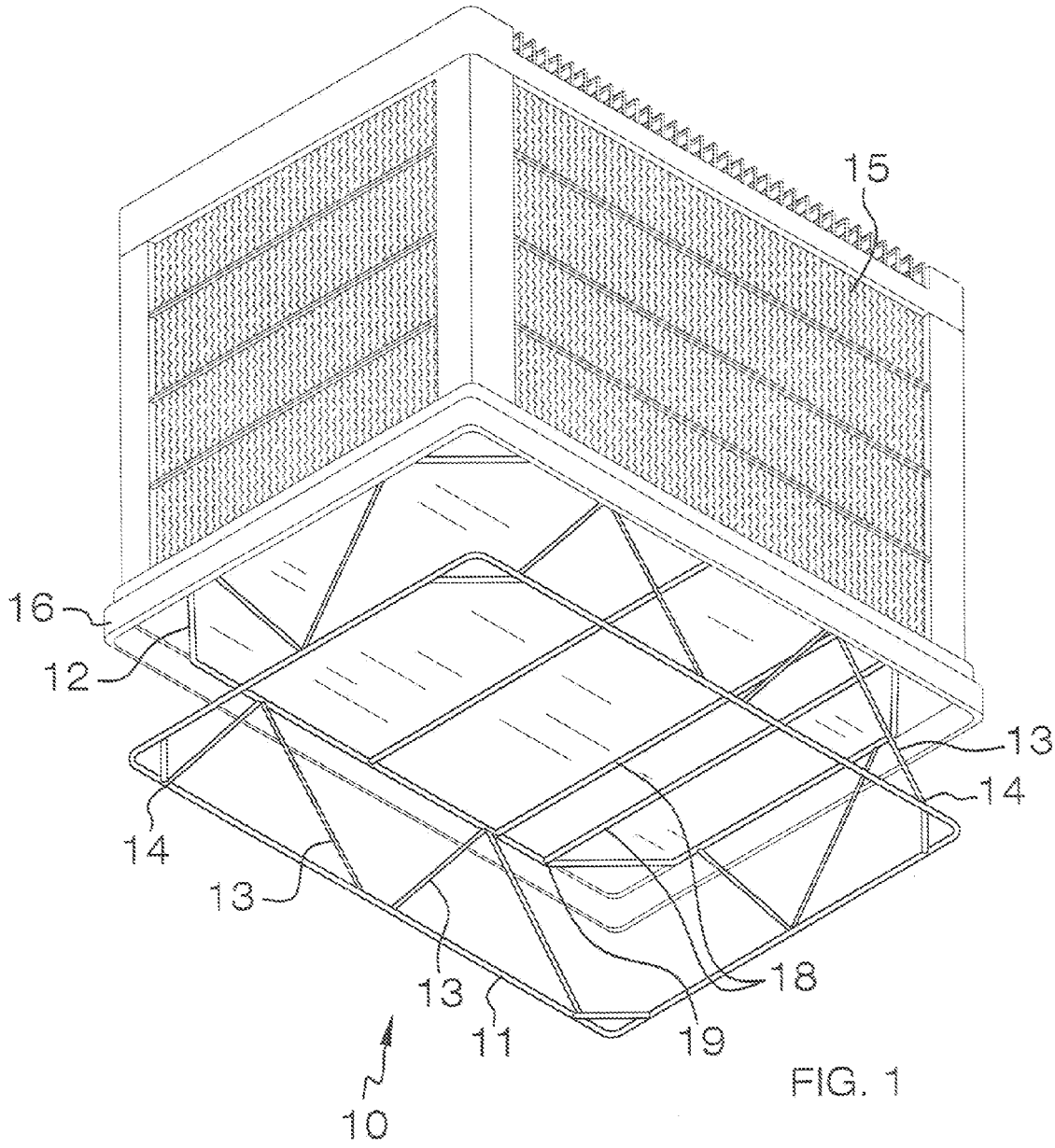
FIG. 1 is a bottom perspective view of a new reversible heat pump stand according to the present invention.
Figure 2:
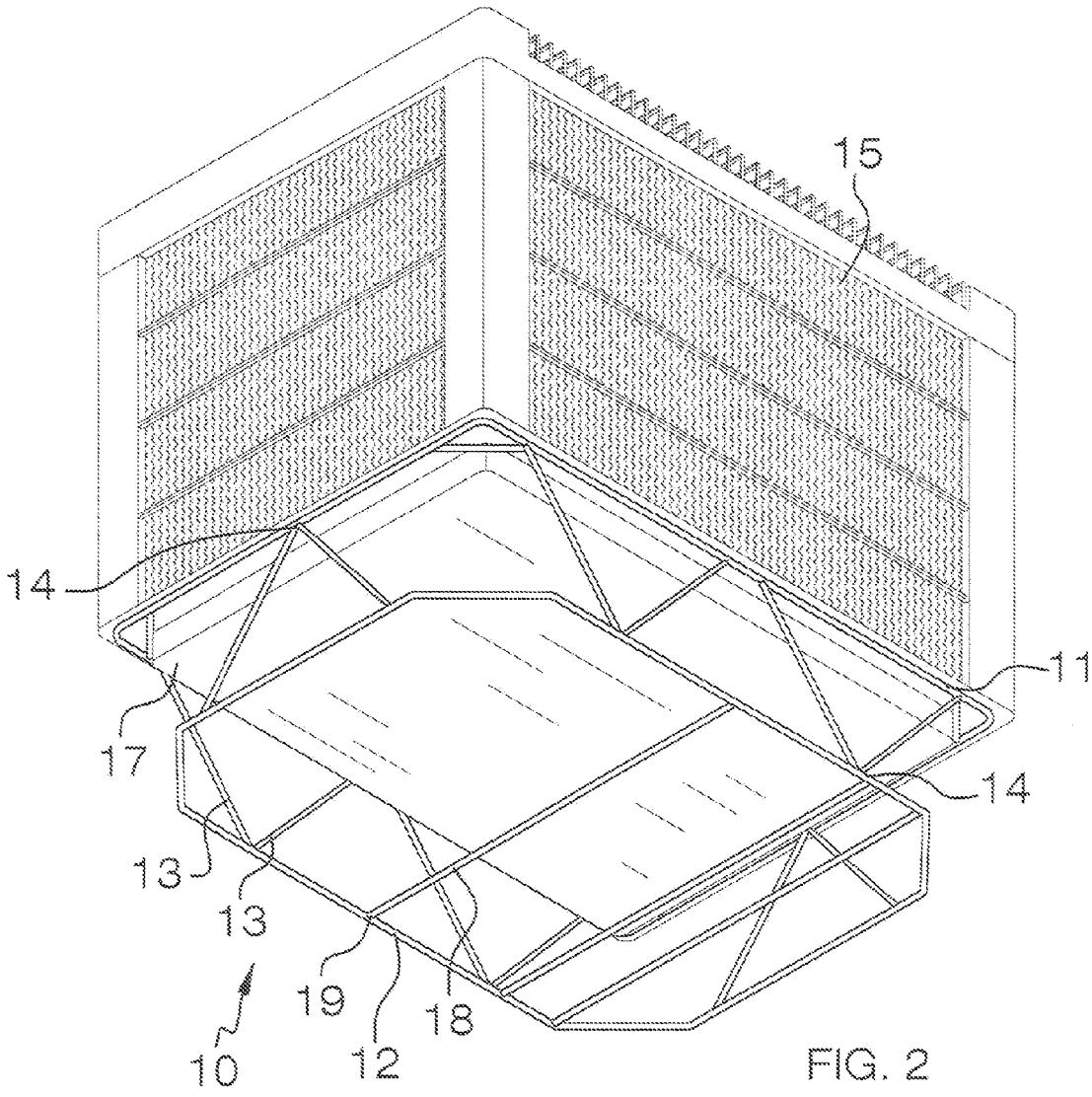
FIG. 2 is another bottom perspective view of the present invention.
Figure 3:
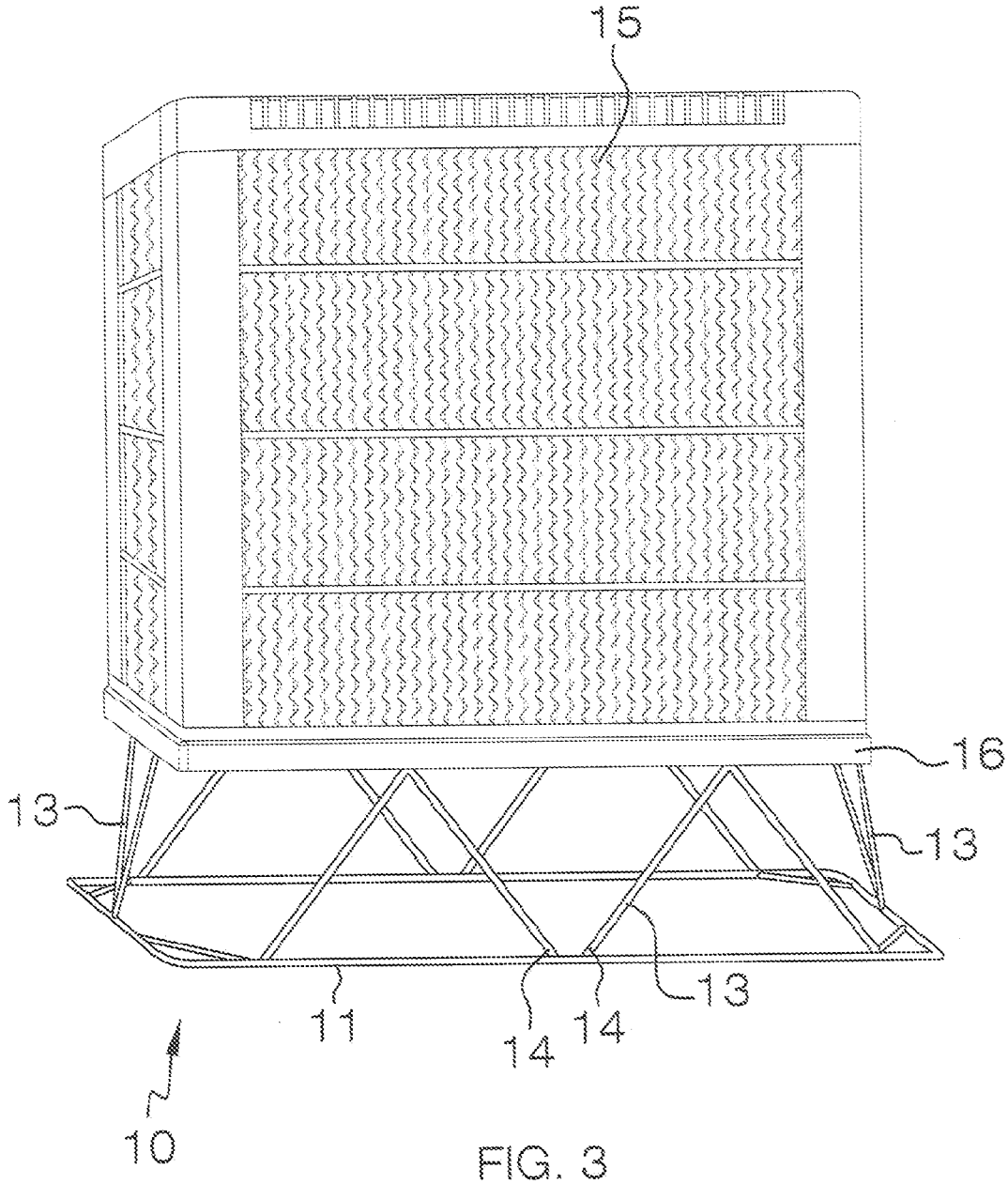
FIG. 3 is front perspective view of the present invention.

With reference now to the drawings, and in particular to FIGS. 1 through 3 thereof, a new reversible heat pump stand embodying the principles and concepts of the present invention and generally designated by the reference numeral 10 will be described.

As best illustrated in FIGS. 1 through 3, the reversible heat pump stand 10 generally comprises a first support frame 11 for securely supporting a heat pump 15 upon a surface; and also comprises a second support frame 12 being conventionally interconnected to the first support frame 11 for also securely supporting the heat pump 15 upon a surface; and further comprises support members being conventionally attached and welded to and interconnecting the first and second support frames 11,12.

The first support frame 11 is a first endless bar 11 having a particular geometrical shape. The second support frame 12 is a second endless bar 12 having a particular geometrical shape. Each of the first and second endless bar 11,12 has a circular lateral cross section and also has a defined narrow thickness. The first and second endless bar 11,12 are spaced apart. The first endless bar 11 rests in a first plane, and the second endless bar 12 rests in a second plane with the first and second planes being parallel to one another. The second endless bar 12 has a perimeter smaller than that of the first endless bar 11. The second endless bar 12 is pyramidally aligned with the first endless bar 11. The first endless bar 11 rests flat upon a surface with the second endless bar 12 being disposed above the first endless bar 11 and with the heat pump resting upon the second endless bar 12. The second endless bar 12 is adjacent to and abutable with a skirt 16 depending from a bottom edge of the heat pump 15 to prevent the heat pump 15 from sliding off the second endless bar 12. In reversal, the second endless bar 12 rests upon a surface with the first endless bar 11 being disposed above the second endless bar 12 with the heat pump 15 resting upon the first endless bar 11. The first endless bar 11 encircles a bottom portion 17 of the heat pump 15 to prevent the heat pump 15 from sliding off the first endless bar 11.

The support members 13 are first bar members 13 having ends 14 being conventionally attached and welded to the first and second endless bar 11,12. Pairs of the first bar members 13 are cooperatively disposed in wedge-shaped arrangements with each first bar member 13 having one of its ends 14 being attached to one of the ends 14 of another first bar member 13 to strengthen, support, and separate the first and second endless bar 11,12.

The reversible heat pump stand 10 further comprises cross members 18 which are second bar members 18 extending within the second endless bar 12 and having ends 19 which are conventionally attached and welded to the second endless bar 12 to support selected components of the heat pump 15. In addition as shown in the figures, the reversible heat pump stand 10 also includes braces being conventionally attached to the first endless bar 11 for the strengthening thereof.

In use, the user places the reversible heat pump stand 10 upon a surface with either the first or second endless bar 11,12 resting upon the surface and either the first or second endless bar 11,12 being disposed above the surface depending upon the style of the heat pump 15 being supported upon the reversible heat pump stand 10. If the heat pump 15 includes a skirt 16 depending from the bottom edge of the heat pump 15, the heat pump 15 will rest upon the second endless bar 12 with the skirt 16 being disposed to the outside of the second endless bar 12 so that the heat pump 15 cannot slide off the reversible heat pump stand 10. If the heat pump 15 includes a boss-like portion 17 extending from the bottom of the heat pump 15, the heat pump 15 will rest upon the first endless bar 11 with the boss-like portion 17 being encircled by the first endless bar 11 to prevent the heat pump 15 from sliding off the reversible heat pump stand 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the reversible heat pump stand. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reversible heat pump stand comprising:

a heat pump;

a first support frame for securely supporting said heat pump upon a surface, said first support frame being a first endless bar;

a second support frame being interconnected to said first support frame for also securely supporting said heat pump upon a surface, said second support frame being a second endless bar, said first and second endless bars are spaced apart, said first endless bar resting in a first plane, and said second endless bar resting in a second plane with said first and second planes being parallel to one another, said first endless bar rests flat upon a surface with said second endless bar being spaced above said first endless bar and with said heat pump resting upon said second endless bar and being elevated above the surface, said second endless bar being adjacent to and abutable with a skirt depending from a bottom of said heat pump to prevent said heat pump from sliding off said second endless bar; and support members interconnecting said first and second support frames.

2. The reversible heat pump stand as described in claim 1, wherein upon the heat pump stand being inverted said second endless bar rests upon a surface with said first endless bar being spaced above said second endless bar with said heat pump resting upon said first endless bar, said first endless bar encircling a bottom underside of said heat pump to prevent said heat pump from sliding off said first endless bar.

* * * * *